US009787011B2

(12) United States Patent
Kurita

(10) Patent No.: US 9,787,011 B2
(45) Date of Patent: Oct. 10, 2017

(54) SURFACE MOUNTING CONTACT MEMBER

(71) Applicant: KITAGAWA INDUSTRIES CO., LTD., Inazawa-shi, Aichi (JP)

(72) Inventor: Tomohisa Kurita, Kasugai (JP)

(73) Assignee: KITAGAWA INDUSTRIES CO., LTD., Inazawa-Shi, Aichi (JP)

( * ) Notice: Subject to any disclaimer, the term of this patent is extended or adjusted under 35 U.S.C. 154(b) by 0 days.

(21) Appl. No.: 14/927,594

(22) Filed: Oct. 30, 2015

(65) Prior Publication Data

US 2016/0126652 A1 May 5, 2016

(30) Foreign Application Priority Data

Oct. 31, 2014 (JP) ..... 2014-222986

(51) Int. Cl.
*H01R 9/24* (2006.01)
*H01R 13/02* (2006.01)
(Continued)

(52) U.S. Cl.
CPC ..... *H01R 13/02* (2013.01); *H01R 4/62* (2013.01); *H01R 12/57* (2013.01); *H01R 13/03* (2013.01);
(Continued)

(58) Field of Classification Search
CPC ..... H01R 13/02
(Continued)

(56) References Cited

U.S. PATENT DOCUMENTS 4,650,723 A 3/1987 Furuya
6,627,329 B1 * 9/2003 Shintani ..... B32B 15/018 428/333
(Continued)

FOREIGN PATENT DOCUMENTS

JP 2009-93806 4/2009
JP 2012094530 5/2012

OTHER PUBLICATIONS

Extended European Search Report from related EPO Appln. No. 15192049.3 dated Mar. 18, 2016.
(Continued)

*Primary Examiner* — Tulsidas C Patel
*Assistant Examiner* — Peter G Leigh
(74) *Attorney, Agent, or Firm* — Grossman, Tucker, Perreault & Pfleger, PLLC

(57) ABSTRACT

A contact member includes a base portion including a joint portion solderable to a first conductor; and an elastic contact portion formed continuously to the base portion and including a contact portion contactable with a second conductor. The base portion and the elastic contact portion form an integrated molded body include a metal thin plate having electrical conductivity and spring characteristic. The plate is a clad material including two or more metal layers stacked in a plate thickness direction of the plate, a first layer serving as one surface layer of the two or more stacked metal layers includes a metal member having a spring characteristic, and a second layer serving as another surface layer of the two or more stacked metal layers includes an aluminum member, the joint portion includes the first layer or the first layer that is plated, and the contact portion includes the second layer.

6 Claims, 4 Drawing Sheets

(51) Int. Cl.

| | |
|---|---|
| ***H01R 4/62*** | (2006.01) |
| ***H01R 12/57*** | (2011.01) |
| ***H01R 13/03*** | (2006.01) |
| ***H01R 13/24*** | (2006.01) |
| *H01R 12/70* | (2011.01) |
| *H01R 12/71* | (2011.01) |

(52) U.S. Cl.
CPC ..... *H01R 13/2442* (2013.01); *H01R 12/7076* (2013.01); *H01R 12/718* (2013.01)

(58) Field of Classification Search
USPC ..... 439/886, 884, 887
See application file for complete search history.

(56) References Cited

U.S. PATENT DOCUMENTS 6,770,383 B2 * 8/2004 Tanaka ..... B32B 15/01 427/123
6,986,669 B2 * 1/2006 Kawai ..... H01R 13/245 174/267
7,048,548 B2 * 5/2006 Mathieu ..... G01R 1/06727 257/E23.021
7,824,776 B2 * 11/2010 Yoshida ..... B32B 15/01 148/537
8,101,285 B2 * 1/2012 Mitose ..... C25D 5/12 148/518
8,231,936 B2 * 7/2012 Song ..... C23C 24/04 427/142
8,915,761 B2 * 12/2014 Kakuta ..... H01R 13/03 428/647
8,926,338 B2 * 1/2015 Kiryu ..... H01R 13/24 439/66
2003/0096519 A1 * 5/2003 Fork ..... B81C 1/00476 439/81
2003/0186597 A1 * 10/2003 Suzuki ..... H01R 13/03 439/886
2005/0037229 A1 * 2/2005 Tanaka ..... C23C 26/00 428/647
2006/0094308 A1 * 5/2006 Chen ..... H01R 13/2442 439/884
2008/0233810 A1 * 9/2008 Chuang ..... H01R 12/57 439/884
2009/0272577 A1 * 11/2009 Shiomi ..... H01L 24/37 174/74 R
2011/0097594 A1 * 4/2011 Tanaka ..... B23K 11/115 428/594
2011/0223779 A1 * 9/2011 Chen ..... H05K 9/0064 439/66
2012/0115375 A1 * 5/2012 Kakuta ..... H01R 13/03 439/877
2012/0202090 A1 8/2012 Yamamoto et al.
2012/0302109 A1 * 11/2012 Qu ..... H01R 13/2442 439/884
2014/0004760 A1 * 1/2014 Kiryu ..... H01R 13/05 439/884
2014/0087605 A1 * 3/2014 Kiryu ..... H01R 13/24 439/884
2015/0024643 A1 * 1/2015 Petrucci ..... H01R 13/03 439/887
2015/0280339 A1 * 10/2015 Saka ..... C25D 7/00 439/886
2016/0120017 A1 * 4/2016 Momoi ..... H05K 1/0203 361/720

OTHER PUBLICATIONS

Office Action from related EPO Appln. No. 15192049.3 dated Dec. 23, 2016.
Office Action from related EPO Appln. No. 15192049.3 dated Jul. 18, 2017.

* cited by examiner

SURFACE MOUNTING CONTACT MEMBER

CROSS-REFERENCE TO RELATED APPLICATION

This application claims priority from Japanese Patent Application No. 2014-222986 filed with the Japanese Patent Office on Oct. 31, 2014, the entire contents of which are hereby incorporated by reference.

BACKGROUND

1. Technical Field

The present disclosure relates to a contact member.

2. Description of the Related Art

A contact member, which is surface-mounted on an electronic circuit board and which contacts, while elastically deforming, another conductive member (for example, a metal casing) other than the electronic circuit board to electrically connect the electronic circuit board and the conductive member together, has been used (for example, see JP-A-2009-093806).

SUMMARY

A contact member according to an embodiment of the present disclosure includes: a base portion including a joint portion solderable to a first conductor; and an elastic contact portion formed continuously to the base portion and including a contact portion contactable with a second conductor. The elastic contact portion has such elasticity that the elastic contact portion elastically deforms in response to contact between the contact portion and the second conductor to bias the contact portion toward the second conductor, the base portion and the elastic contact portion form an integrated molded body including a metal thin plate having electrical conductivity and a spring characteristic, the metal thin plate is a clad material including two or more metal layers stacked in a plate thickness direction of the metal thin plate, a first layer serving as one surface layer of the two or more stacked metal layers includes a metal member having a spring characteristic, and a second layer serving as another surface layer of the two or more stacked metal layers includes an aluminum member, the joint portion includes the first layer or the first layer that is plated, and the contact portion includes the second layer.

DETAILED DESCRIPTION

Figure 1:
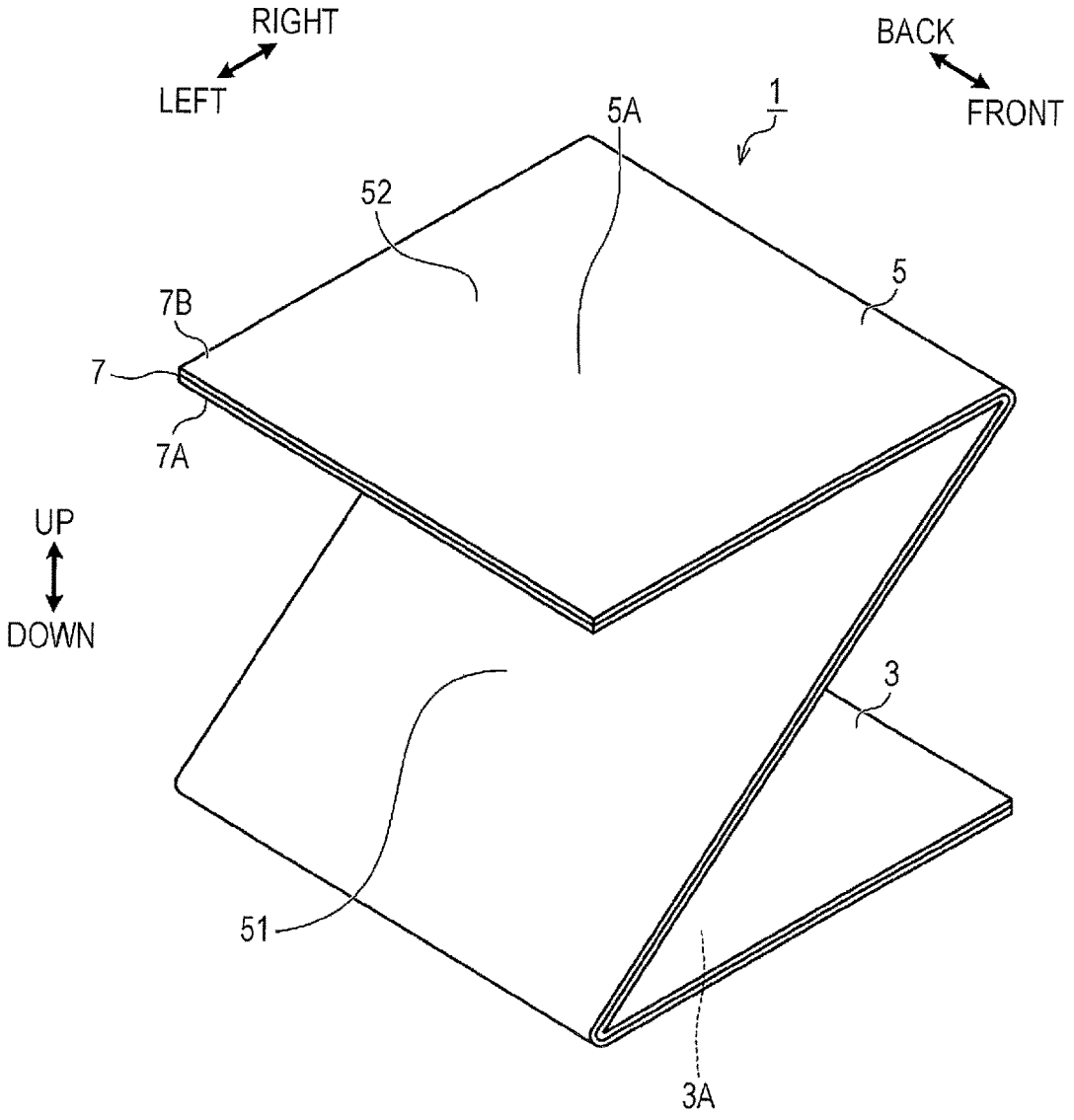
FIG. 1 is a perspective view illustrating a contact member of a first embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Components made of copper alloy (e.g., phosphor bronze) having high spring characteristics and gold-plated components made of such copper alloy have been commercially available as the above-described contact member, for example.

However, in the case where such a contact member is in contact with an aluminum casing, corrosion (e.g., galvanic corrosion) of aluminum might be caused due to contact between different types of metal.

In view of the above-described situation, it is desirable to provide a contact member which can suppress occurrence of corrosion of an aluminum component even when contacting the aluminum component.

A contact member described below includes: a base portion including a joint portion solderable to a first conductor; and an elastic contact portion formed continuously to the base portion and including a contact portion contactable with a second conductor. The elastic contact portion has such elasticity that the elastic contact portion elastically deforms in response to contact between the contact portion and the second conductor to bias the contact portion toward the second conductor, the base portion and the elastic contact portion form an integrated molded body including a metal thin plate having electrical conductivity and a spring characteristic, the metal thin plate is a clad material including two or more metal layers stacked in a plate thickness direction of the metal thin plate, a first layer serving as one surface layer of the two or more stacked metal layers includes a metal member having a spring characteristic, and a second layer serving as another surface layer of the two or more stacked metal layers includes an aluminum member, the joint portion includes the first layer or the first layer that is plated, and the contact portion includes the second layer.

According to the contact member configured as described above, the contact member can be surface-mounted on an electronic circuit board including the first conductor. Moreover, in surface-mounting, the contact member can contact the second conductor to electrically connect the first conductor and second conductor together.

The contact portion of the elastic contact portion includes the second layer made of aluminum. Accordingly, even if a contact target with which the elastic contact portion is brought into contact is an aluminum member (e.g., an aluminum casing), the aluminum portions contact each other. Thus, the occurrence of corrosion (e.g., galvanic corrosion) due to contact between different types of metal can be suppressed.

Different types of metal have different material-specific impedances. Thus, in the case where contact between the contact member and the second conductor is contact between different types of metal, the characteristics of transmission between the contact member and the second conductor tends to be lowered. On the other hand, contact between the above-described contact member and the second conductor is contact between identical types of metal. Thus, as long as the portions made of the same type of metal are electrically connected together as described above, lowering of the characteristics of transmission between the contact member and the second conductor can be suppressed.

Meanwhile, different types of metal are joined together at the joint boundary between the first layer and second layer. Unlike the portion where different types of metal merely contact each other, metal atoms contained in each layer slightly spread, in joining, at the joint boundary between the first layer and second layer. As a result, an intermetallic compound containing different types of metal is formed at the joint boundary between the first layer and second layer. In addition, unlike the portion where different types of metal merely contact each other, a room that oxygen or water contained in air enters is small at the joint boundary between the first layer and second layer. For this reason, it is difficult to generate metal oxide or the like. Thus, the transmission characteristics at the joint boundary between the first layer and second layer as described above are favorable as compared to those when contact between the contact member and the second conductor is mere contact between different types of metal.

As necessary, the joint portion of the base portion includes the plated first layer. In the case where the first layer includes a solderable metal member, no plating is required. In the case where the first layer includes a metal member difficult to be soldered, the first layer can be plated so that the first layer becomes solderable. Unlike the base portion made only of aluminum, the base portion configured as described above can be properly soldered to the first conductor. Moreover, the first layer is made of metal having spring characteristics. Thus, unlike an elastic contact portion made only of aluminum, the elastic contact portion can be provided with desired spring characteristics.

In addition, the metal thin plate used for production of the contact member is a clad material. This clad material is obtained in such a manner that two or more metal layers stacked in the plate thickness direction are pressure-joined together. Thus, even in, e.g., a small contact member having a maximum dimension of about several millimeters, the maximum joint area between adjacent metal layers can be ensured. Thus, a sufficient joint strength between adjacent metal layers can be ensured. This is significantly different from an elastic contact portion, to only a tip end portion of which an aluminum member is attached.

Next, the above-described contact member will be described with reference to exemplary embodiments. Note that, as necessary, the description made below refers to each of the front-back, right-left, and up-down directions indicated in figures. It is noted that each of these directions is defined only for the sake of simply explaining the relative positional relationship among the components forming the contact member. Thus, in, e.g., use of the contact member, the contact member can be disposed in any orientation.

(1) First Embodiment

First, a first embodiment will be described. As illustrated in FIG. 1, a contact member 1 described as an example in the first embodiment includes a base portion 3 and an elastic contact portion 5 formed continuously to the base portion 3. The base portion 3 and the elastic contact portion 5 form an integrated molded body. The integrated molded body is obtained in such a manner that a metal thin plate 7 having electrical conductivity and spring characteristics is press-molded.

In the present embodiment, the base portion 3 is formed in a flat plate shape whose plate thickness direction is along the up-down direction as viewed in FIG. 1. Moreover, the base portion 3 is formed in a rectangular shape in plan view (i.e., as viewed from the above). The elastic contact portion 5 includes a first portion 51 and a second portion 52. The first portion 51 is bent from one side of the rectangular base portion 3 to diagonally extend upward. The second portion 52 is bent from an upper end of the first portion 51 to extend parallel to the base portion 3. The second portion 52 is formed in a rectangular shape in plan view, and is disposed to exactly overlap with the base portion 3 in plan view.

Note that the contact member 1 is configured to be mounted on an electronic circuit board, by using an automatic mounting machine, as a surface mounted component. In mounting by the automatic mounting machine, an upper surface of the second portion 52 as viewed in FIG. 1 is used as a suction surface which can be sucked by a suction nozzle of the automatic mounting machine.

The metal thin plate 7 is, e.g., a clad material including two metal layers 7A and 7B stacked on each other in the plate thickness direction by pressure-joining Of these two metal layers 7A and 7B, the first layer 7A which is a surface layer positioned opposite to the metal layer 7B contactable with a later-described second conductor includes a solderable metal (phosphor bronze in the present embodiment) member having spring characteristics. The second layer 7B which is a surface layer contactable with the second conductor includes an aluminum member.

The thickness of the second layer 7B in the plate thickness direction is smaller than that of the first layer 7A. More specifically, the thin plate 7 has a thickness of 0.102 mm The thickness of the first layer 7A of the thin plate 7 is 0.096 mm, and the thickness of the second layer 7B of the thin plate 7 is 0.006 mm. Thus, the ratio between the thickness T1 of the first layer 7A and the thickness T2 of the second layer 7B is 16:1.

As described above, in the thin plate 7 including the second layer 7B thinner than the first layer 7A, the characteristics of the first layer 7A having higher spring characteristics than those of the second layer 7B become dominant as compared to a thin plate 7 including a second layer 7B thicker than a first layer 7A. Thus, the spring characteristics of the entirety of the thin plate 7 are enhanced. This results in higher spring characteristics of the elastic contact portion 5. As a result, the elastic contact portion 5 can be favorably elastically deformed.

Figure 2:
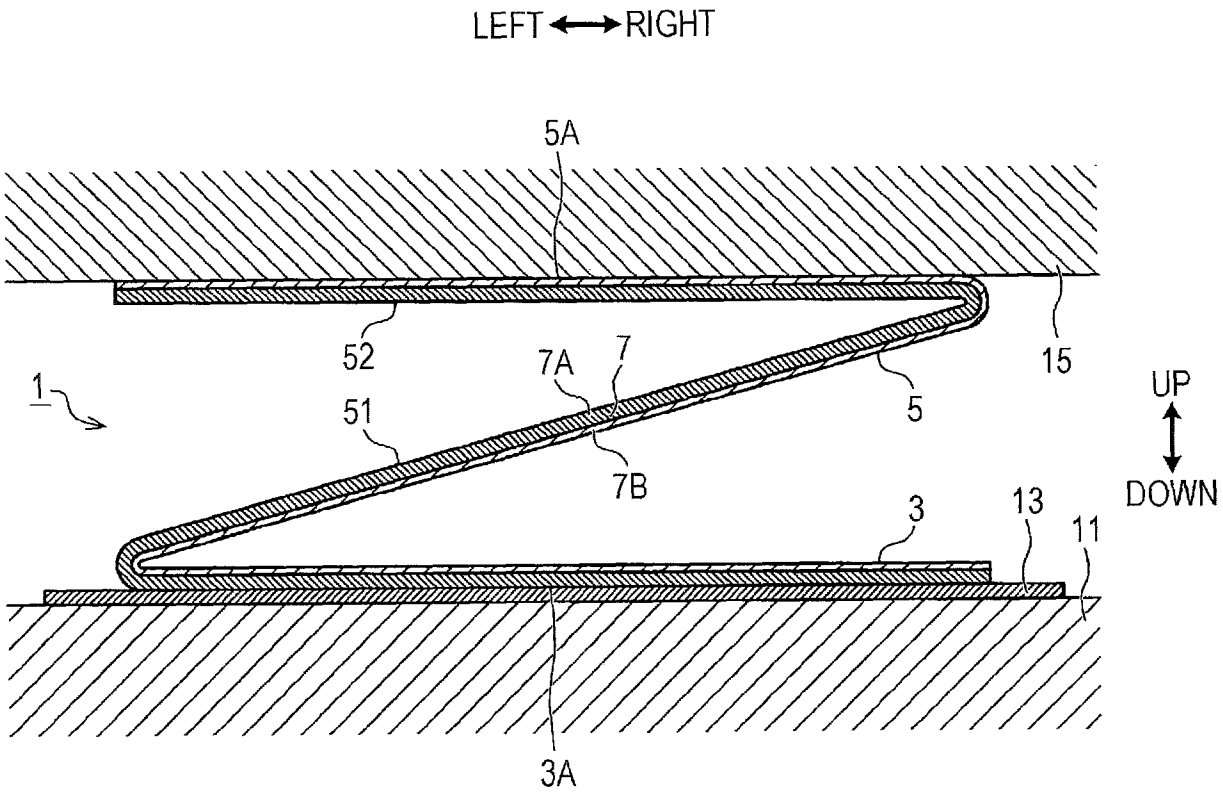
FIG. 2 is a cross-sectional view illustrating the use state of the contact member of the first embodiment.

The base portion 3 includes a joint portion 3A facing downward as viewed in FIG. 1. When the contact member 1 is used, the joint portion 3A is soldered to an electrical conductive pattern 13 (equivalent to an example of the first conductor of the present embodiment) of an electronic circuit board 11 as illustrated in FIG. 2. The first layer 7A forming the joint portion 3A is made of solderable metal. Thus, the joint portion 3A can be favorably soldered to the electrical conductive pattern 13.

The elastic contact portion 5 includes a contact portion 5A facing upward as viewed in FIG. 1. When the contact member 1 is used, the contact portion 5A contacts an aluminum casing 15 (equivalent to an example of the second conductor of the present embodiment) as illustrated in FIG. 2. When the contact portion 5A of the elastic contact portion 5 comes into contact with the aluminum casing 15, the elastic contact portion 5 elastically deforms. Accordingly, the contact portion 5A is displaced toward the base portion 3. Thus, while the contact portion 5A is displaced, the elastic contact portion 5 continuously biases the contact portion 5A toward the aluminum casing 15. This maintains favorable contact between the contact portion 5A and the aluminum casing 15.

Part of the second layer 7B at the contact portion 5A includes the aluminum member. Thus, contact between the contact portion 5A and the aluminum casing 15 is contact between identical types of metal. This can suppress the corrosion (e.g., galvanic corrosion) due to contact between different types of metal. Moreover, the contact portion 5A and the aluminum casing 15, as the portions made of the same type of metal, are electrically connected together. Thus, lowering of transmission characteristics due to a difference in material-specific impedance as in electrical connection between different types of metal can be suppressed.

Meanwhile, different types of metal are joined together at the joint boundary between the first layer 7A and second layer 7B. Unlike the portion where different types of metal merely contact each other, metal atoms contained in each layer slightly spread, in joining, at the joint boundary between the first layer 7A and second layer 7B. As a result, an intermetallic compound containing different types of metal is formed at the joint boundary between the first layer 7A and second layer 7B. In addition, unlike the portion where different types of metal merely contact each other, a room that oxygen or water contained in air enters is small at the joint boundary between the first layer 7A and second layer 7B. For this reason, it is difficult to generate metal oxide or the like. Thus, the transmission characteristics at the joint boundary between the first layer 7A and second layer 7B as described above are favorable as compared to those when contact between the contact member and the second conductor is mere contact between different types of metal.

As the structure ensuring the spring characteristics of the elastic contact portion 5 and including the contact portion 5A containing aluminum, the structure including a first portion 51 made of metal having spring characteristics and a second portion 52 made of aluminum is conceivable. However, with such a structure, the boundary between different types of metal (the joint portion between different types of metal) is formed within a narrow area including the boundary between the first portion 51 and the second portion 52. On the other hand, according to the structure in which two metal layers 7A and 7B stacked in the plate thickness direction of the thin plate 7 by pressure-joining or the like in production of the metal thin plate 7 are provided as in the above-described embodiment, a sufficiently large joint area can be ensured. Thus, the joint strength between the first layer 7A and the second layer 7B can be enhanced.

(2) Second Embodiment

Figure 3:
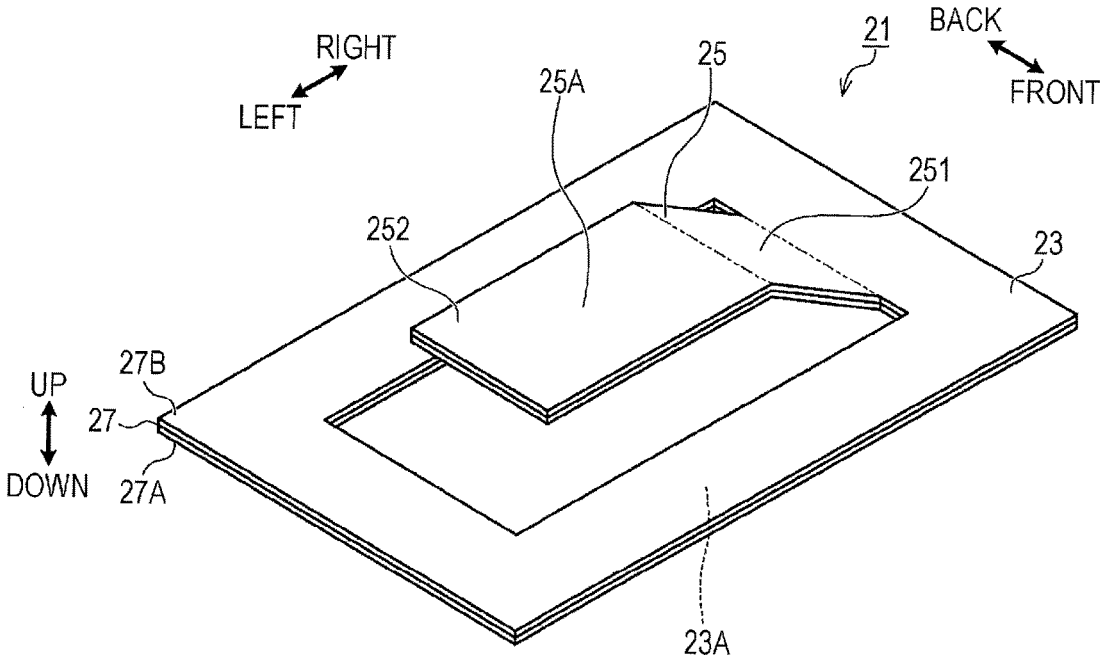
FIG. 3 is a perspective view illustrating a contact member of a second embodiment.

Next, a second embodiment will be described. Note that the second embodiment and the embodiments described thereafter have a lot in common with the first embodiment. For this reason, differences from the first embodiment will be mainly described in detail. A contact member 21 described as an example in the second embodiment includes, as illustrated in FIG. 3, a base portion 23 and an elastic contact portion 25 formed continuously to the base portion 23. The base portion 23 and the elastic contact portion 25 form an integrated molded body, which is obtained in such a manner that a metal thin plate 27 having electrical conductivity and spring characteristics is press-molded into a predetermined shape.

In the present embodiment, the base portion 23 is formed in a flat plate shape whose plate thickness direction is along the up-down direction as viewed in FIG. 3. Moreover, the base portion 23 is formed in a rectangular frame shape in plan view (i.e., as viewed from the above). The elastic contact portion 25 includes a first portion 251 and a second portion 252. The first portion 251 diagonally extends upward from an inner peripheral side of the frame-shaped base portion 23. The second portion 252 extends from an upper end of the first portion 251 in the direction parallel to the base portion 23. An upper surface of the second portion 252 as viewed in FIG. 3 is used as a suction surface which can be sucked by a suction nozzle of an automatic mounting machine.

The metal thin plate 27 is the same member as that of the first embodiment. This member is, e.g., a clad material obtained in such a manner that a first layer 27A made of phosphor bronze and a second layer 27B made of aluminum are pressure-joined together. As in the first embodiment, the thickness of the second layer 27B in the plate thickness direction is smaller than that of the first layer 27A.

Figure 4:
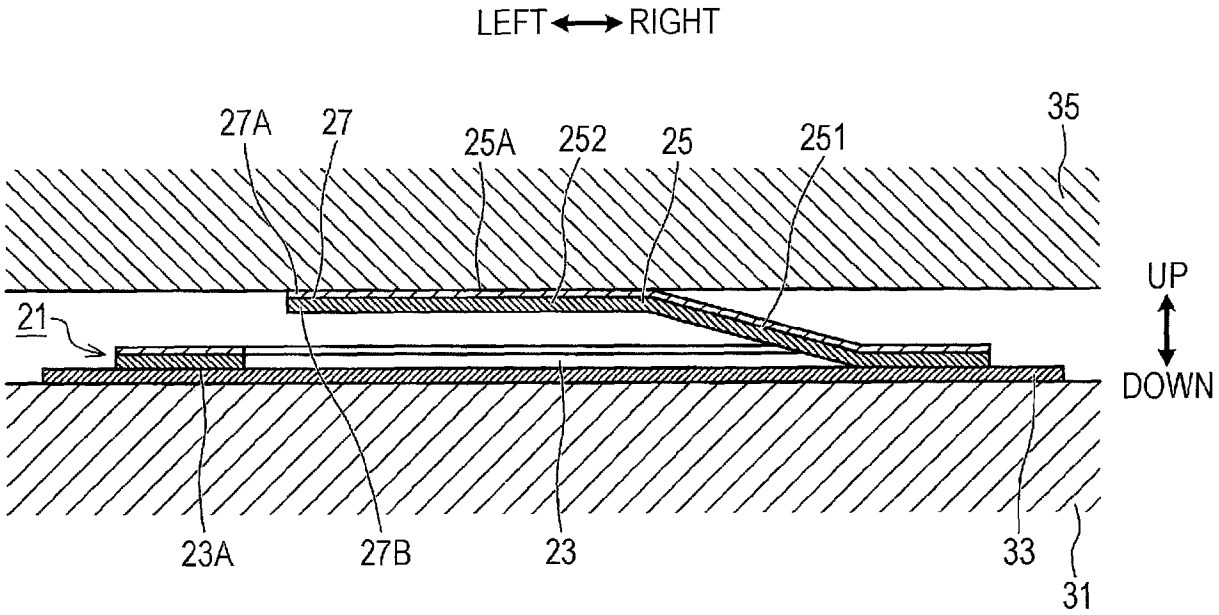
FIG. 4 is a cross-sectional view illustrating the use state of the contact member of the second embodiment.

The base portion 23 includes a joint portion 23A facing downward as viewed in FIG. 3. When the contact member 21 is used, the joint portion 23A is soldered to an electrical conductive pattern 33 (equivalent to an example of the first conductor described in the present specification) of an electronic circuit board 31 as illustrated in FIG. 4.

The elastic contact portion 25 includes a contact portion 25A facing upward as viewed in FIG. 3. When the contact member 21 is used, the contact portion 25A contacts an aluminum casing 35 (equivalent to an example of the second conductor described in the present specification) as illustrated in FIG. 4. When the contact portion 25A of the elastic contact portion 25 comes into contact with the aluminum casing 35, the elastic contact portion 25 elastically deforms. Accordingly, the contact portion 25A is displaced toward the base portion 23. Thus, while the contact portion 25A is displaced, the elastic contact portion 25 continuously biases the contact portion 25A toward the aluminum casing 35.

The specific shape of the contact member 21 configured as described above is different from that of the first embodiment. Note that the present embodiment is the same as the first embodiment in that the contact portion 25A made of aluminum contacts the aluminum casing 35 and that the joint portion 23A made of phosphor bronze is soldered to the electrical conductive pattern 33. The present embodiment is also the same as the first embodiment in that the elastic contact portion 25 includes the clad material having the first layer 27A made of phosphor bronze and the like to ensure sufficient spring characteristics. Thus, the second embodiment offers the same features and advantageous effects as those of the first embodiment on the above-described points.

(3) Other Embodiments

The contact member has been described above with reference to representative embodiments. However, the above-described embodiments are set forth merely as exemplary embodiments of the present disclosure. That is, the embodiments of the present disclosure are not limited to the above-described exemplary embodiments. Various other embodiments can be implemented without departing from the technical idea of the present disclosure.

For example, in the above-described embodiments, phosphor bronze is described as an example of the solderable metal having spring characteristics. However, as long as metal has spring characteristics, metal other than phosphor bronze may be used. Examples of such metal include beryllium copper, nickel silver, stainless steel, titanium copper, and nickel-tin copper. That is, the above-described first layers 7A and 27A may be formed of a member containing any of these metals. Of these metals, phosphor bronze, nickel silver, and beryllium copper can be particularly used as the metal material contained in the above-described first layers 7A and 27A in view of high spring characteristics and excellent fatigue resistance.

Examples of the above-described metal having spring characteristics may include metal which cannot be easily soldered, such as stainless steel. In the case of employing such metal, the first layer at the joint portion can be plated. Plate may contain such metal that the joint portion becomes solderable. Examples of such metal include gold plate, tin plate, and nickel plate. Note that the joint portion of the first layer made of easily-solderable metal may be plated as described above.

In the first embodiment described above, the thicknesses of the first layer 7A and the second layer 7B in the plate thickness direction are specifically described as an example. These layer thicknesses are merely an example, and a specific numerical value for thickness can be optionally changed. As described above, however, the second layer 7B can be formed thinner than the first layer 7A. For example, the ratio T1:T2 between the thickness T1 of the first layer 7A and the thickness T2 of the second layer 7B may fall within a range of 1.5:1 to 20:1. When the thickness T1 of the first layer 7A falls below 1.5 times as large as the thickness T2 of the second layer 7B, the thickness of the aluminum layer relatively increases. For this reason, a design for ensuring the spring characteristics of the elastic contact portion 25 is required. When the thickness T1 of the first layer 7A exceeds 20 times as large as the thickness T2 of the second layer 7B, the thickness of the aluminum layer relatively decreases. For this reason, when the aluminum layer is worn out or damaged, the first layer 7A is easily exposed at the worn-out portion or the damaged portion. Thus, considering these points, the above-described ratio T1:T2 can be adjusted within a range of 1.5:1 to 20:1.

Further, in the above-described embodiments, the thin plate 7 is formed of the clad material including the first layer 7A made of phosphor bronze and the second layer 7B made of aluminum, the first layer 7A and the second layer 7B being stacked on each other. However, the clad material may have a stack of three or more layers. Examples of the clad material include a clad material having a three-layer structure including a first layer made of phosphor bronze, a second layer made of aluminum, and a third layer interposed between the first layer and second layer and made of other type of metal. Even when the clad material having such a structure is used, the aluminum layer is formed as a surface layer on one side and the phosphor bronze layer is formed as a surface layer on the other side. Thus, even such a contact member offers the same features and advantageous effects as those of each of the above-described embodiments are provided. Examples of addition of the third and succeeding layers include the example where a metal layer is optionally added according to a purpose such as improvement of the mechanical strength of the contact member, improvement of spring characteristics, or improvement of electrical conductivity. In the case of providing three or more layers as described above, the ratio T1:T2 between the thickness T1 of part, excluding the second layer, of the multiple layers in the plate thickness direction and the thickness T2 of the second layer in the plate thickness direction may fall within a range of 1.5:1 to 20:1.

In each of the above-described embodiments, the specific shape of the contact member is described as an example. As long as the contact member includes a thin plate 7, 27 formed of a clad material as described above, and is a press-molded body having a predetermined shape, the same features and advantageous effects as those of the contact member of each of the above-described embodiments can be expected even with shape details different from those of the contact member of each of the above-described embodiments. Thus, even the contact members having optionally-determined different shape details also fall with the scope of the embodiments of the present disclosure. Of various contact members molded from metal thin plates, the contact members including the clad material used in the embodiments of the present disclosure also fall within the scope of the embodiments of the present disclosure.

The contact members of the embodiments of the present disclosure may be any of the following first to fourth contact members.

The first contact member is a contact member which can be surface-mounted on an electronic circuit board including a first conductor and which is configured to contact a second conductor different from the first conductor to electrically connect the first conductor and second conductor together. The contact member includes: a base portion including a joint portion solderable to the first conductor; and an elastic contact portion formed continuously to the base portion, including a contact portion contactable with the second conductor, and configured to elastically deform in response to contact with the second conductor to bias the contact portion toward the second conductor. The base portion and the elastic contact portion are integrally molded together in such a manner that a metal thin plate having electrical conductivity and spring characteristics is processed into a predetermined shape. The metal thin plate is a clad material including two or more metal layers stacked in the plate thickness direction thereof by pressure-joining A first layer serving as one surface layer is made of metal having spring characteristics, and a second layer serving as the other surface layer is made of aluminum. The joint portion is formed of the first layer or a plated first layer. The contact portion is formed of the second layer.

The second contact member is the first contact member configured such that the first layer is made of any of phosphor bronze, beryllium copper, nickel silver, stainless steel, titanium copper, or nickel-tin copper.

The third contact member is the first or second contact member configured such that the thickness of the second layer in the plate thickness direction is formed thinner than the thickness of part, excluding the second layer, of the multiple layers in the plate thickness direction.

The fourth contact member is the third contact member configured such that the ratio T1:T2 between the thickness T1 of part, excluding the second layer, of the multiple layers in the plate thickness direction and the thickness T2 of the second layer in the plate thickness direction falls within a range of 1.5:1 to 20:1.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A contact member comprising:

a base portion including a joint portion solderable to a first conductor; and an elastic contact portion formed continuously to the base portion and including a contact portion contactable with a second conductor, wherein the elastic contact portion has such elasticity that the elastic contact portion elastically deforms in response to contact between the contact portion and the second conductor to bias the contact portion toward the second conductor, the base portion and the elastic contact portion form an integrated molded body including a metal thin plate having electrical conductivity and a spring characteristic, the metal thin plate is a clad material including two or more metal layers stacked in a plate thickness direction of the metal thin plate, a first layer serving as one surface layer of the two or more stacked metal layers includes a metal member having a spring characteristic, and a second layer serving as another surface layer of the two or more stacked metal layers includes an aluminum member, the joint portion includes the first layer or the first layer that is plated, and the contact portion includes the second layer.

2. The contact member according to claim 1, wherein the first layer includes any of metal members including phosphor bronze, beryllium copper, nickel silver, stainless steel, titanium copper, or nickel-tin copper.

3. The contact member according to claim 1, wherein a thickness of the second layer in the plate thickness direction is smaller than a thickness of part, excluding the second layer, of the two or more stacked metal layers in the plate thickness direction.

4. The contact member according to claim 2, wherein a thickness of the second layer in the plate thickness direction is smaller than a thickness of part, excluding the second layer, of the two or more stacked metal layers in the plate thickness direction.

5. The contact member according to claim 3, wherein a ratio T1:T2 between the thickness T1 of the part, excluding the second layer, of the two or more stacked metal layers in the plate thickness direction and the thickness T2 of the second layer in the plate thickness direction falls within a range of 1.5:1 to 20:1.

6. The contact member according to claim 4, wherein a ratio T1:T2 between the thickness T1 of the part, excluding the second layer, of the two or more stacked metal layers in the plate thickness direction and the thickness T2 of the second layer in the plate thickness direction falls within a range of 1.5:1 to 20:1.

* * * * *